US006544018B2

(12) United States Patent
Heckel et al.

(10) Patent No.: US 6,544,018 B2
(45) Date of Patent: Apr. 8, 2003

(54) HYDRAULIC MOTOR HAVING MULTIPLE SPEED RATIO CAPABILITY

(75) Inventors: John B. Heckel, Bloomington, MN (US); Marvin L. Bernstrom, Eden Prairie, MN (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/020,971

(22) Filed: Dec. 19, 2001

(65) Prior Publication Data

US 2002/0041816 A1 Apr. 11, 2002

Related U.S. Application Data

(63) Continuation-in-part of application No. 09/649,490, filed on Aug. 28, 2000, now abandoned.

(51) Int. Cl.[7] ..... F03C 2/08
(52) U.S. Cl. ..... 418/61.3; 418/60
(58) Field of Search ..... 418/60, 61.3

(56) References Cited

U.S. PATENT DOCUMENTS 3,778,198 A * 12/1973 Giversen ..... 418/61.3
4,586,885 A * 5/1986 Middlekauff ..... 418/61.3
5,071,327 A * 12/1991 Brewer ..... 418/61.3

* cited by examiner

*Primary Examiner*—John J. Vrablik
(74) *Attorney, Agent, or Firm*—L. J. Kasper

(57) ABSTRACT

A multiple speed ratio gerotor motor having first (13) and second (19) gerotor gear sets as the displacement mechanisms, and a commutating valve member (43) of the well known type. In one embodiment (FIGS. 1–5) there is provided a selector valve section (15) disposed between the first and second gerotor gear sets, and in a low speed mode (FIG. 5A), fluid flows from the commutating valve member (43) through the first volume chambers (39), then through the selector valve section, then through the second volume chambers (66). In a high speed mode (FIG. 5B), flow out of the first volume chambers (39) is blocked by the selector valve section (15), and fluid in the second volume chambers (66) flows through the selector valve section to the case drain region (106). In a free wheel mode (FIG. 5C), both the first and second volume chambers are open to case drain. In another embodiment (FIG. 6), the selector valve section (15) is disposed between the commutating valve member (43) and the first gerotor gear set (13), and can permit, or block, fluid communication to either gerotor gear set separately, thus providing three speed capability. In either embodiment, the relative speed ratios which can be achieved are determined by the relative axial lengths of the two gerotor gear sets, thus providing much greater flexibility in the choice of high-speed, low-torque speed ratios.

12 Claims, 8 Drawing Sheets

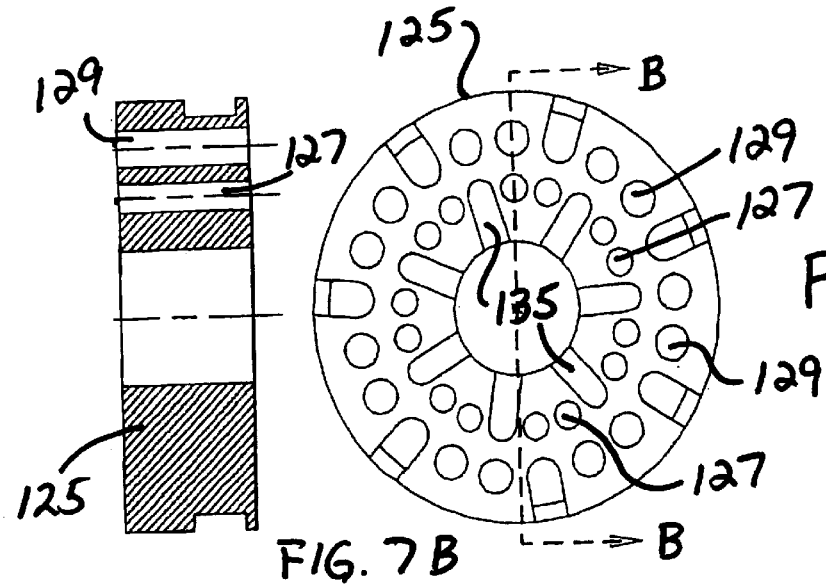
FIG. 7A
FIG. 7B
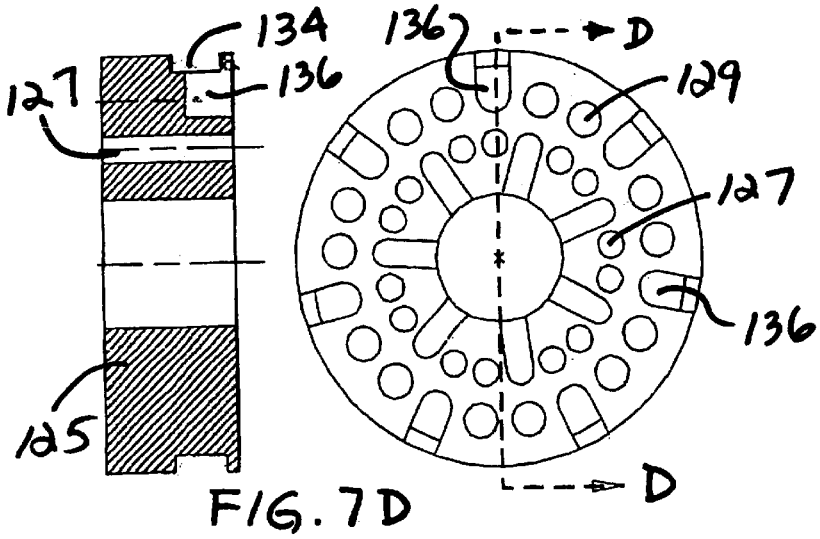
FIG. 7C
FIG. 7D
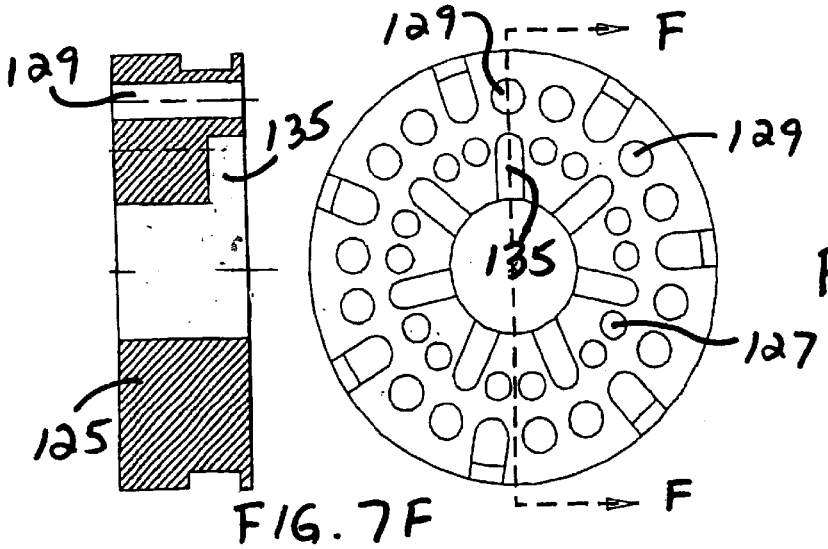
FIG. 7E
FIG. 7F

HYDRAULIC MOTOR HAVING MULTIPLE SPEED RATIO CAPABILITY

CROSS-REFERENCE TO RELATED APPLICATIONS

This application is a continuation-in-part (CIP) of application U.S. Ser. No. 09/649,490, filed Aug. 28, 2000, abandoned, in the name of John B. Heckel and Marvin L. Bernstrom for a "Hydraulic Motor Having Multiple Speed Ratio Capability".

BACKGROUND OF THE DISCLOSURE

The present invention relates to rotary fluid pressure devices of the type in which a gerotor gear set serves as the fluid displacement mechanism, and more particularly, to such devices which are provided with multiple speed ratio capability.

Although the teachings of the present invention can be applied to devices having fluid displacement mechanisms other than gerotors, such as cam lobe type devices, the invention is especially adapted to gerotor devices and will be described in connection therewith.

Devices utilizing gerotor gear sets can be used in a variety of applications, one of the most common being to use the device as a low-speed, high-torque (LSHT) motor. One common application for low-speed, high-torque gerotor motors is vehicle propulsion, wherein the vehicle includes an engine driven pump which provides pressurized fluid to a pair of gerotor motors, with each motor being associated with one of the drive wheels. Those skilled in the art will be aware that many gerotor motors utilize a roller gerotor, especially on larger, higher torque motors of the type used in propel applications, and subsequent references hereinafter to "gerotors" will be understood to mean and include both conventional gerotors, as well as roller gerotors.

In recent years, there has been a desire on the part of the vehicle manufacturers to be able to provide both the low-speed, high-torque (LSHT) mode of operation, such as when the vehicle is at the work site, and also a high-speed, low-torque (HSLT) mode of operation, for when the vehicle is traveling ("roading") between work sites. One possible solution has been to provide a gerotor motor having a two-speed capability.

Two-speed gerotor motors are known from U.S. Pat. No. 4,480,971, assigned to the assignee of the present invention and incorporated herein by reference. The device of the cited patent has been in widespread commercial use and has performed in a generally satisfactory manner. As is well known to those skilled in the art, a gerotor motor may be operated as a two-speed-ratio device by providing valving which can effectively "recirculate" fluid between expanding and contracting fluid volume chambers of the gerotor gear set. In other words, if the inlet port communicates with all of the expanding chambers, and all of the contracting chambers communicate with the outlet port, the motor operates in the normal LSHT mode. If some of the fluid from the contracting chambers is recirculated back to some of the expanding chambers, the result will be operation in the HSLT mode, which is the same result as if the displacement of the gerotor were decreased, but with the same flow rate through the gerotor.

Although the two-speed gerotor motors which are in use commercially have been generally satisfactory, there have been certain inherent limitations present in these motors. The primary limitation in the known two-speed gerotor motors relates to the speed ratios available. For example, if the displacement mechanism of the motor is an 8/9 gerotor, in which the star has eight external teeth and the ring has nine internal teeth, and if the motor is designed to have every other volume chamber recirculate, then the available speed ratios are 1.0:1 (LSHT) and 2.0:1 (HSLT).

Therefore, in the general case, the ratio in the HSLT mode is the total number of volume chambers divided by the number of volume chambers which are "active", i.e., which do not recirculate. In order to provide two different motor models, each having a different HSLT ratio, it has been necessary, when utilizing the prior art, to change the number of volume chambers which recirculate, from one model to the next, thus necessitating a major change in the design of at least a portion of the motor.

Accordingly, it is a primary object of the present invention to provide an improved multiple speed ratio arrangement, especially suited for use with a gerotor motor, which results in greater flexibility in the choice of HSLT speed ratios.

It is a more specific object of the present invention to provide such an improved multiple speed ratio arrangement which accomplishes the above-stated object, without the need for any substantial redesign of the motor in order to be able to provide different models having different HSLT speed ratios.

Another functional limitation which has been inherent in the prior art two-speed gerotor motors is simply the fact that these motors have effectively been limited to two different speed ratios, i.e., the 1.0:1 low speed ratio with no volume chambers recirculating and the HSLT speed ratio determined by the number of volume chambers which are recirculating, as described above. Increasingly, there are vehicle applications in which it is recognized as being desirable to have more than just two speed ratios available.

Accordingly, it is another object of the present invention to provide an improved multiple speed ratio arrangement which accomplishes the above-stated objects and which further has the capability of providing at least a third speed ratio.

Finally, as is well know to those skilled in the art, it is desirable on many vehicles of the type which are propelled by hydraulic motors that the vehicle be capable of being towed. In order for the vehicle to be towed, however, the motors which propel the vehicle must be capable of operating in a "free wheel" mode, or else towing the vehicle and causing the motor to operate as a pump will cause the fluid to overheat and may result in damage to the motor. As is also well known to those skilled in the art, when the fluid overheats, it begins to lose its lubrication capability, which is a primary reason for damage to occur to various parts of the motor.

One way to provide the free wheel capability in the motor, so that the vehicle can be towed, is to provide the propel circuit valving with a bypass feature. Therefore, with the propel circuit valving in a bypass condition, fluid can flow to and from the motor, through the valving, but with relatively little restriction to fluid flow. Unfortunately, adding such bypass capability to conventional propel circuit valving adds substantially to the overall cost and complexity of the valving, and of the overall propel circuit.

Accordingly, it is still another object of the present invention to provide an improved gerotor motor having a multiple speed arrangement which accomplishes the above-stated objects while at the same time providing the motor with free wheel capability, but without the added cost and complexity in the propel circuit necessitated by the prior art solution.

BRIEF SUMMARY OF THE INVENTION

The above and other objects of the invention are accomplished by the provision of a rotary fluid pressure device comprising a housing defining a fluid inlet port and a fluid outlet port. A fluid pressure operated displacement means is associated with the housing and includes a first internally toothed ring member and a first externally toothed star member eccentrically disposed within the first ring member for relative orbital and rotational movement therein to define a plurality N+1 of expanding and contracting first fluid volume chambers in response to the orbital and rotational movements. A commutating valve means cooperates with the housing to provide fluid communication between the inlet port and the first expanding volume chambers and between the first contracting volume chambers and the outlet port. A shaft means is included for transmitting the rotational movement of the first star member.

The improved device is characterized by the fluid pressure operated displacement means including a second internally toothed ring member and a second externally toothed star member eccentrically disposed within the second ring member for orbital and rotational movement therein, to define a plurality N+1 of expanding and contracting second volume chambers in response to the orbital and rotational movements. The device includes connection means for connecting the second star member to the first star member for common orbital and rotational movement therewith. A selector valve means is operably associated with the first and second ring members and is operable in a first low speed position to permit fluid communication to each of the first volume chambers, and its corresponding second volume chamber, and a second high speed position in which the commutating valve means permits communication of pressurized fluid to only one of the first and second volume chambers, and permits fluid communication between each of the other of the first and second volume chambers and a fluid recirculation chamber.

BRIEF DESCRIPTION OF THE DRAWINGS

FIGS. 7A, 7C, and 7E are transverse cross-sections, similar to FIG. 3, but showing only the selector valve member of the embodiment of FIG. 6, while FIGS. 7B, 7D, and 7F are axial cross-sections taken on lines B—B, D—D, and F—F of FIGS. 7A, 7C, and 7E, respectively.

DETAILED DESCRIPTION OF THE PREFERRED EMBODIMENT

Figure 1:
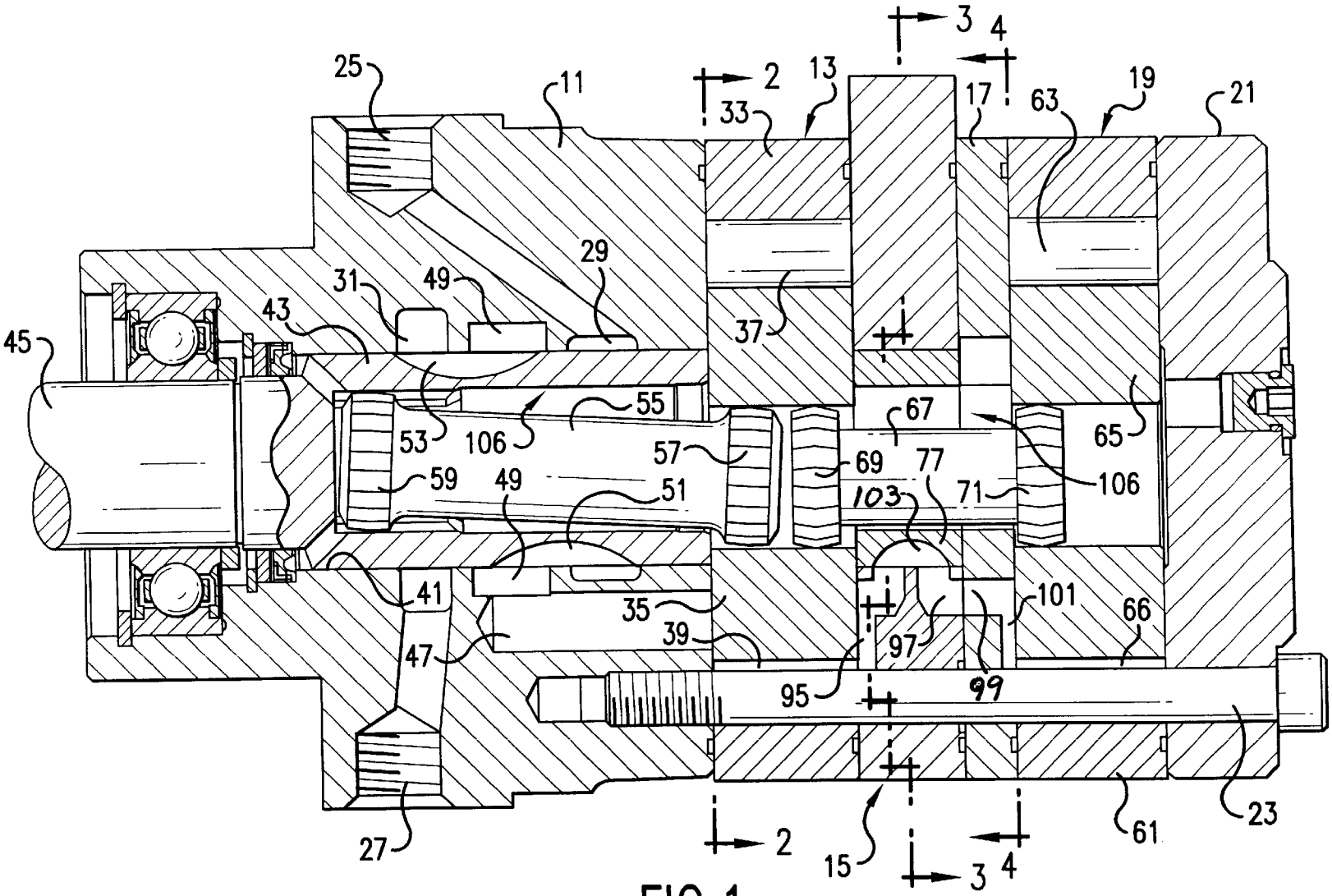
FIG. 1 is an axial cross-section of a gerotor motor including the multiple speed ratio arrangement of the present invention.

Referring now to the drawings, which are not intended to limit the invention, FIG. 1 is an axial cross-section of a low-speed, high torque gerotor motor including the multiple speed ratio arrangement of the present invention. The gerotor motor shown in FIG. 1 may be of the general type illustrated and described in U.S. Pat. Nos. 4,592,704 and 6,062,835, both of which are assigned to the assignee of the present invention and incorporated herein by reference, and are sold commercially by the assignee of the present invention.

Figure 2:
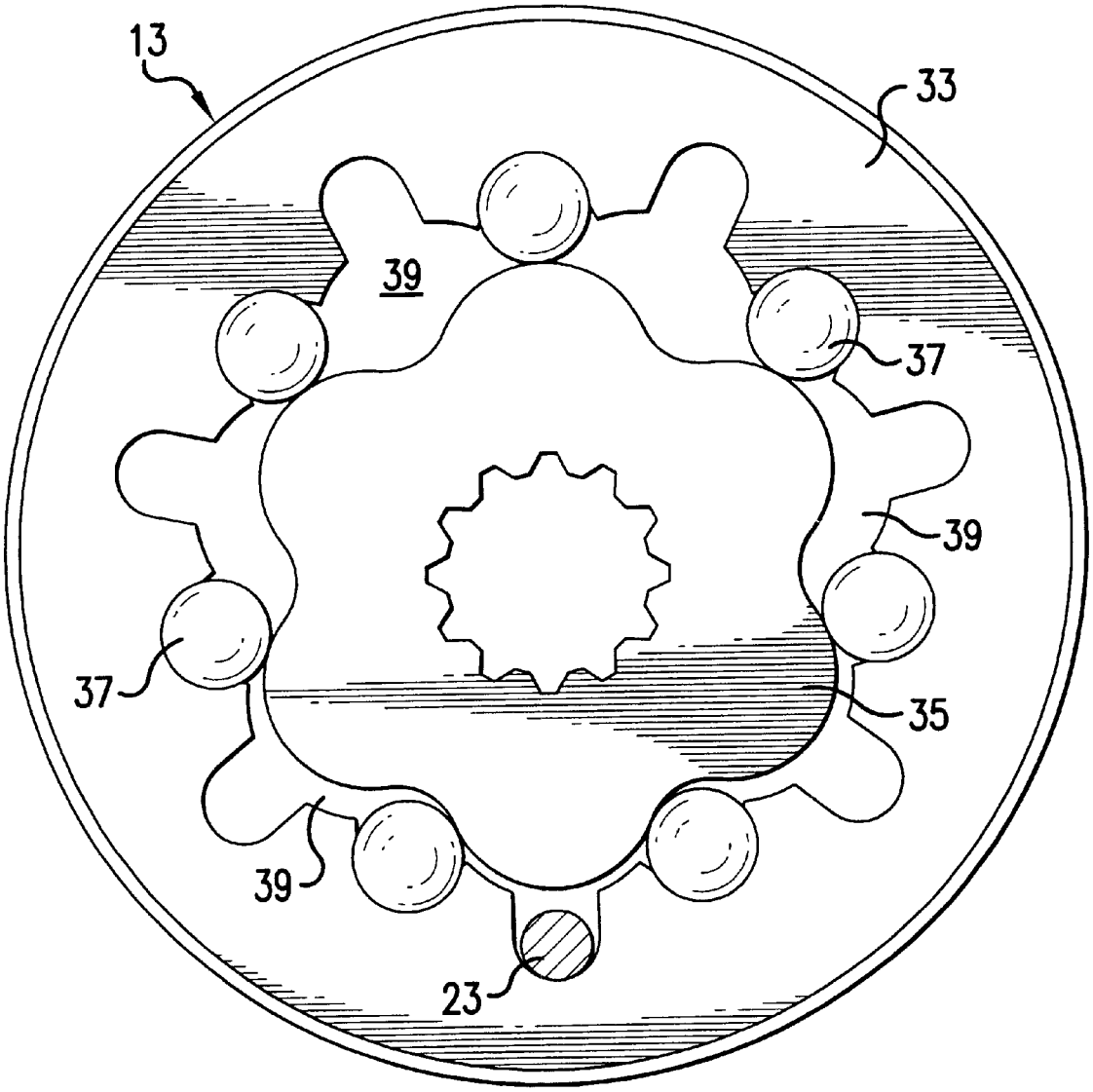
FIG. 2 is a transverse cross-section, taken on line 2—2 of FIG. 1, and on approximately the same scale, illustrating a gerotor displacement mechanism.
Figure 3:
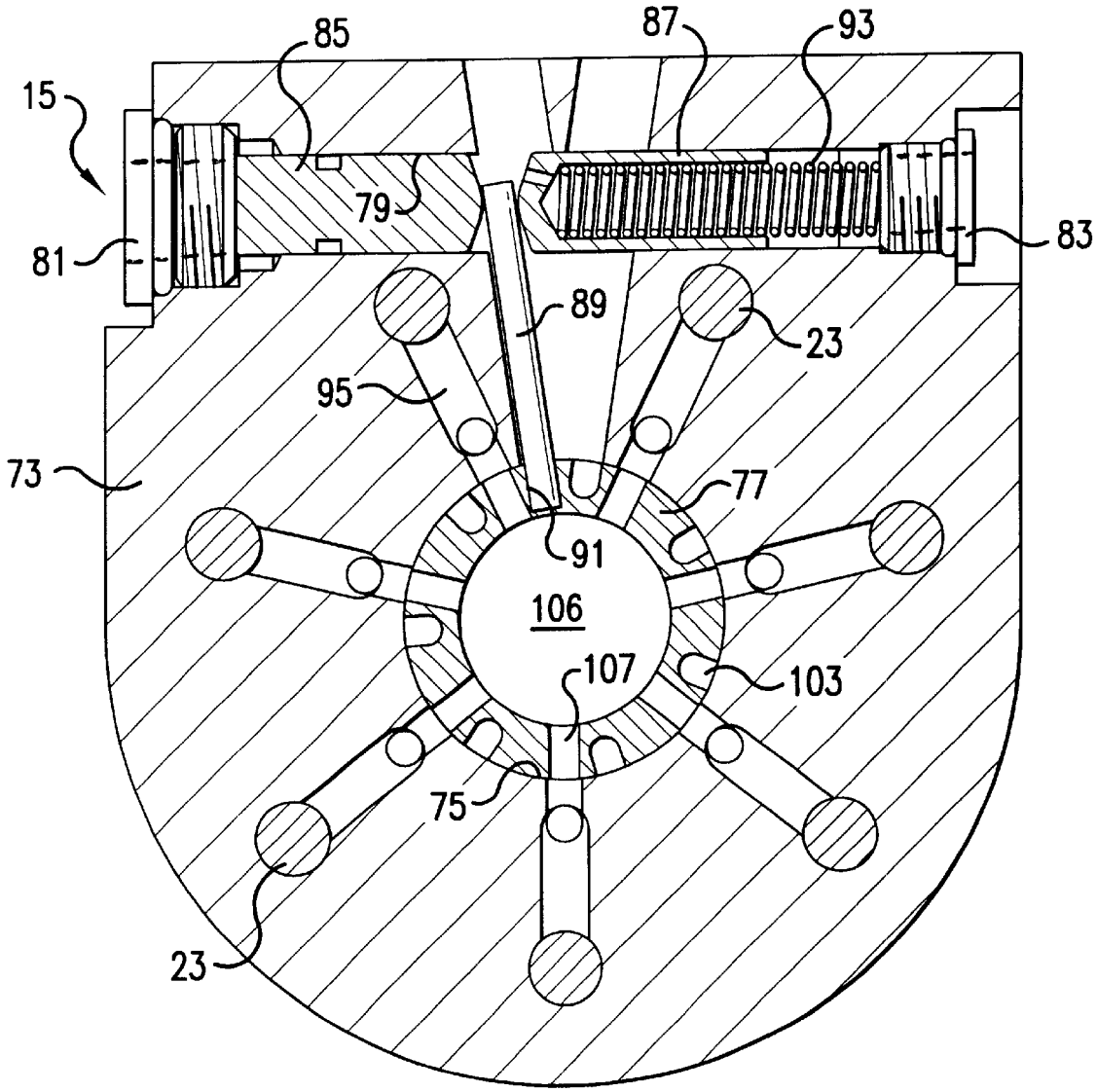
FIG. 3 is a transverse cross-section, taken on line 3—3 of FIG. 1, and on a somewhat larger scale, illustrating the selector valve which comprises part of the multiple speed arrangement of the present invention.
Figure 4:
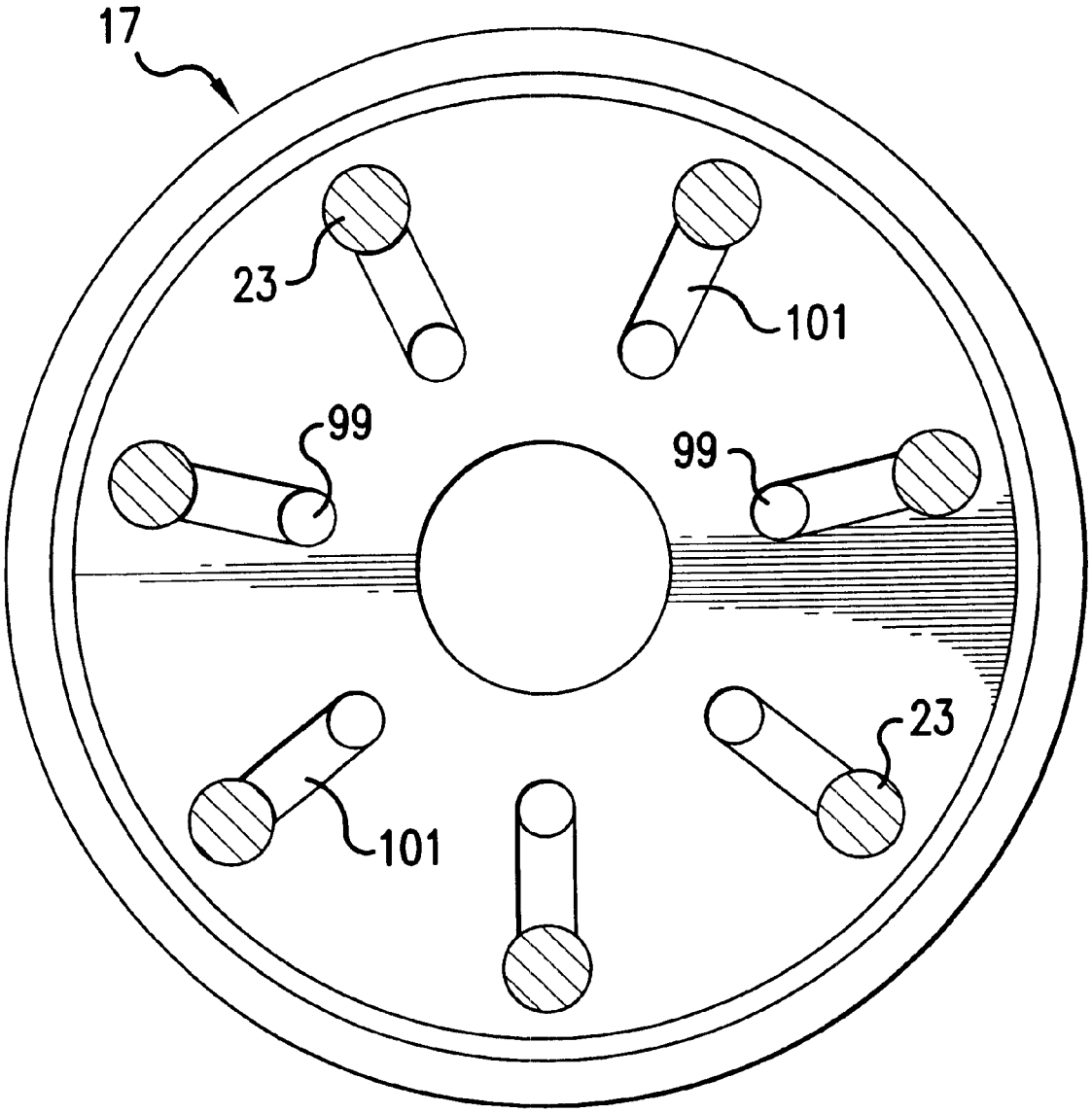
FIG. 4 is a transverse cross-section, taken on line 4—4 of FIG. 1, and on approximately the same scale, showing a plan view of the spacer plate disposed axially adjacent the selector valve shown in FIG. 3.

The gerotor motor of FIG. 1 comprises a valve housing section 11, and a fluid energy-translating displacement mechanism, generally designated 13, which, in the subject embodiment, is a roller gerotor gear set, shown in greater detail in FIG. 2. Disposed immediately adjacent the gerotor gear set 13 is a selector valve section, generally designated 15, to be described in greater detail subsequently, and adjacent thereto is a spacer plate 17 (see FIG. 4), and adjacent thereto is a second fluid energy translating displacement mechanism, generally designated 19 which, in the subject embodiment, is also a roller gerotor gear set. Finally, the motor includes a rearward end cap 21, and all of the portions of the motor from the valve housing section 11 through the end cap 21 are held in tight, sealing engagement by means of a plurality of bolts 23, only one of which is shown in FIGS. 1 and 2, but all of which are shown in FIGS. 3 and 4.

The valve housing section 11 includes a fluid inlet port 25 and a fluid outlet port 27, the ports 25 and 27 communicating fluid to and from a pair of annular grooves 29 and 31, respectively, defined by the housing section 11. It is understood by those skilled in the art that the ports 25 and 27 may be reversed, thus reversing the direction of operation of the motor.

Referring now to FIGS. 1 and 2 together, the gerotor gear set 13 includes an internally toothed ring member 33, through which the bolts 23 pass. Disposed eccentrically within the ring member 33 is an externally toothed star member 35. The internal teeth of the ring member 33 comprise a plurality of cylindrical rollers 37, as is now well known in the art. The internal teeth or rollers 37 of the ring member 33 and the external teeth of the star member 35 inter-engage to define a plurality N+1 of expanding and contracting fluid volume chambers 39, in which N is the generic designation of the number of external teeth on the gerotor star 35 or 65, as is also well known in the art.

The valve housing section 11 defines a spool bore 41, and rotatably disposed therein is a spool valve 43. Formed integrally with the spool valve 43 is an output shaft 45, shown only fragmentarily in FIG. 1. It should be understood by those skilled in the art that, although the subject embodiment of the invention utilizes the spool valve 43 to perform the required commutating valving function, the invention is not so limited, and various other types of valving could be utilized, one of which is illustrated hereinafter in the embodiment of FIG. 8. For example, and within the scope of the present invention, the spool valve 43 could be replaced by some form of disk valve in which the commutating valving function is performed on a transverse, planar surface, rather than on a cylindrical surface, as in the case of the spool valve 43.

In fluid communication with each of the volume chambers 39 is an axial bore 47 defined by the valve housing section 11, and in fluid communication with each of the bores 47, and opening into the spool bore 41, is an opening 49. In a manner well know to those skilled in the art, the openings 49 are in commutating fluid communication, first with the annular groove 29, and then with the annular groove 31, by means of axial slots 51 and then axial slots 53, respectively, formed in the spool valve 43, as is well know in the art.

Disposed within the hollow, cylindrical spool valve 43 is a main drive shaft 55, commonly referred to as a "dogbone" shaft. The drive shaft 55 (omitted in FIG. 2) has a spline connection 57 with the star member 35, and similarly, has a spline connection 59 with the spool valve 43 (and therefore, with the output shaft 45). Thus, by means of the drive shaft 55, the orbital and rotational movement of the star member 35 is transmitted into purely rotational movement of the output shaft 45, as is well known.

Referring again primarily to FIGS. 1 and 2, it should be noted that for purposes of the present invention, the gerotor gear set 19 is substantially identical (in transverse cross-section) to the gerotor gear set 13 (such that FIG. 2 can actually represent either gear set). However, such is not essential to the present invention, as will become apparent subsequently to those skilled in the gerotor motor art. In the subject embodiment, the gerotor gear sets 13 and 19 are both 6/7 gerotors, thus defining a plurality N+1 of the volume chambers 39, with N+1=7 in FIG. 2. Thus, it should be understood that what is essential for the present invention is not that the two gerotor gear sets be identical (in transverse cross-section), although such would typically be the preferred arrangement, but all that is truly essential is that the number of volume chambers N+1 be the same for both gerotor gear sets 13 and 19, whereby the commutator valve timing is the same for both gerotor gear sets. However, it is not essential that the eccentricities of the 2 gerotors be equal, although it would probably be more common than not to provide such equality in the eccentricities.

Referring again primarily to FIG. 1, it may be seen that the second gerotor gear set 19 includes an internally toothed ring member 61 having, as its internal teeth, a plurality of rollers 63, and eccentrically disposed within the ring member 61 is an externally toothed star member 65. The internal teeth or rollers 63 of the ring member 61 and the external teeth of the star member 65 inter-engage to define a plurality of expanding and contracting fluid volume chambers 66, in the same manner as in the first gerotor gear set 13. The motor includes a secondary drive shaft 67 (which could also be referred to as a "dogbone" shaft). The drive shaft 67 has a spline connection 69 with the star member 35, and similarly, has a spline connection 71 with the second star member 65. Thus, the drive shaft 67 serves as a connection means so that the first star member 35 and the second star member 65 have common orbital and rotational movement. The spline connections 69 and 71 are illustrated herein as being crowned, in view of the earlier explanation that the eccentricities of the two gerotor gear sets 13 and 19 do not have to be equal.

Referring now primarily to FIG. 3, it should first be noted that, for ease of illustration, the secondary drive shaft 67 is omitted from FIG. 3, and furthermore, not all parts of FIG. 3 are taken on the same plane of FIG. 1. The selector valve section 15 includes a selector valve housing 73, with the spacer plate 17 being disposed immediately adjacent, and in engagement with a rearward surface of the housing 73. The housing 73 defines a generally cylindrical valve chamber 75, and disposed within the chamber 75 is a rotatable, generally cylindrical selector valve member 77. The valving action accomplished by the selector valve member 77 will be described in detail subsequently.

The selector valve housing 73 also defines a transverse bore 79, the left end of the bore 79 being provided with a fitting 81, and the right end of the bore 79 being provided with a fitting 83. As will be understood by those skilled in the art of hydraulic controls (pilot controls), the fittings 81 and 83 would be connected to a source of pilot pressure, such that pilot pressure could be communicated, selectively, to either the left end of the bore 79, or to the right end of the bore 79. Disposed within the transverse bore 79 is a pair of pilot pistons 85 and 87, and disposed axially between the pistons 85 and 87 is a lever member 89 which is received within a bore 91 formed in the selector valve 77. Operably disposed between the fitting 83 and the pilot piston 87 is a coil compression spring 93, such that, in the absence of pilot pressure at the fitting 81, the lever member 89 and the selector valve member 77 are biased to the position shown in FIG. 3.

When pilot pressure is communicated through the fitting 81, the pilot piston 85 is biased to the right from the position shown in FIG. 3, thus moving the lever member 89 to the right, to a centered position, and rotating the selector valve 77 clockwise from the position shown in FIG. 3. While pilot pressure is being communicated through the fitting 81, and now drained from the fitting 83, the pilot piston 85 is biased even further to the right from the position shown in FIG. 3, thus moving the lever member 89 all the way to the right, and rotating the selector valve 77 further clockwise from the position shown. Thus, the position shown in FIG. 3 and the two additional positions described hereinabove comprise three different operating conditions of the selector valve section 15, the significance of which will be understood subsequently. It should be understood by those skilled in the art that the pilot arrangement, shown in FIG. 3, for controlling the rotational position of the selector valve 77 is not an essential feature of the invention, and various other known means of rotating the valve 77 could, within the scope of the invention, be utilized.

Referring now primarily to FIGS. 1, 3 and 4, the selector valve housing 73 defines a plurality N+1 of fluid passages 95 which, as may best be seen in FIG. 1, are formed on the forward surface of the valve housing 73, but then extend axially rearward a short distance, and then extend radially inward, opening into the valve chamber 75. As noted previously, N+1 is common terminology in the gerotor art to designate the number of internal teeth on the ring member. Therefore, there are the same number of fluid passages 95 as there are volume chambers 39 or 66. Thus, the fluid in each of the first volume chambers 39 is communicated through its respective fluid passage 95, and is present at the exterior surface of the selector valve member 77. Similarly, and as is shown only in FIG. 1, the selector valve housing 73 defines a plurality N+1 of fluid passages 97, each of which opens into the valve chamber 75 at a location axially adjacent the opening of the respective fluid passage 95. Each fluid passage 97 then opens, at the rearward surface of the valve housing 73, into an axially extending portion 99 of a fluid passage 101. In the same manner that each of the first volume chambers 39 is in fluid communication with its respective fluid passage 95, each fluid passage 101 is in communication with its respective second fluid volume chamber 66.

Referring now primarily to FIGS. 1, 3 and 5A, 5B and 5C, the selector valve member 77 will be described in greater detail. Adjacent each of the N+1 pairs of axially aligned fluid passages 95 and 97, the selector valve member 77 defines three different valve configurations, and which of the three is instantly in communication with the fluid passages 95 and 97 depends upon the rotational position of the selector valve 77 which, in turn, is determined by the communication of pilot pressure, as described previously.

Figure 5C:
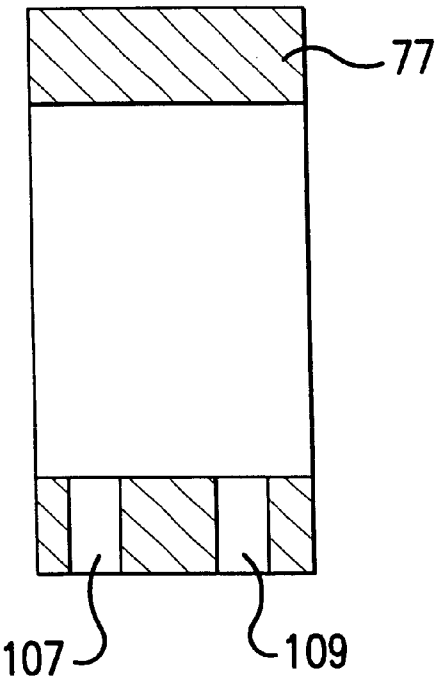
FIGS. 5A, 5B, and 5C are axial cross-sections through the selector valve member of the present invention, rotated to three different positions, illustrating, respectively, the low speed, high speed, and free wheel modes of operation.
Figure 5B:
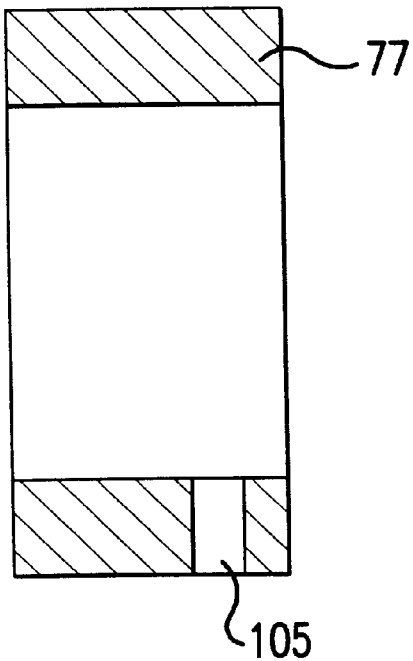
Figure 5A:
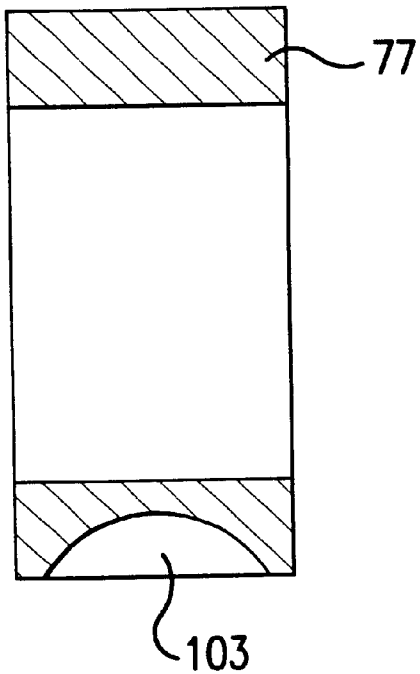

The selector valve member 77 defines a plurality N+1 of elongated axial slots 103, and when the valve member 77 is in the rotational position shown in FIGS. 1 and 5A, the motor operates in the LSHT mode. In this mode, pressurized fluid is communicated from the inlet port 25, and through certain of the axial bores 47 to the expanding volume chambers 39. However, with the selector valve member 77 in the position shown in FIG. 5A, pressurized fluid entering each expanding volume chamber 39 can flow through the adjacent fluid passage 95, then through the axial slot 103, and then through the fluid passages 97 and 101 into the second expanding volume chamber 66. The result, in terms of the ratio of motor output speed to input flow, is the same as if there were only a single gerotor gear set, equal to the sum (in terms of axial length, assuming equal gerotor displacements per unit length) of the gear sets 13 and 19.

The selector valve member 77 defines a plurality N+1 of radial bores 105 (not visible in FIG. 3). When the selector valve member 77 is rotated to the position shown in FIG. 5B, pressurized fluid from the inlet port 25 flows through certain of the axial bores 47 into expanding volume chambers 39, but for each of the expanding volume chambers 39, its respective fluid passage 95 now merely communicates to the exterior cylindrical surface of the valve member 77, such that there is no fluid flow into or out of the volume chambers 39, except through the axial bores 47, in the normal manner. At the same time, each of the second volume chambers 66 is in communication through its fluid passages 101 and 97 with its respective radial bore 105, such that each of the second volume chambers 66 is now in open fluid communication with a case drain region 106 of the motor, i.e., that portion of the motor surrounding the drive shafts 55 and 67.

The case drain region 106 may also be referred to hereinafter, and in the appended claims as a "fluid recirculation region", for reasons which will become apparent to those skilled in the art. Thus, the motor now operates in the HSLT mode in which the ratio of the output speed of the motor to the input flow is much higher (because only the gerotor gear set 13 is "active"). Those skilled in the art will understand that, although the fluid recirculation region is illustrated and described in the embodiment of FIGS. 1 through 5 as being the case drain region of the motor, such is not essential to the invention. Alternatively, the fluid recirculation region could be in fluid communication with the high pressure inlet port fluid, or with some sort of "control" pressure, such as from a system charge pump. All that is essential to the invention is that the fluid recirculation region comprise a fluid source from which, and to which, fluid may be communicated to either or both of the gerotor gear sets without resulting in highly restricted flow, or substantial heat generation.

In the subject embodiment, and by way of example only, because the gerotor gear sets 13 and 19 are approximately equal in length, the LSHT ratio is 1.0:1 (as it always is), whereas the HSLT ratio is about 2.0:1. In other words, the flow volume of the gerotor gear set 13 alone is about one-half of the flow volume of the gear sets 13 and 19 together, so the speed in the HSLT mode is about twice the speed in the LSHT mode. In accordance with an important aspect of the invention, the HSLT ratio can easily be varied, from one motor model to the next, merely by changing the length of one of the gerotor gear sets, and probably also the length of the bolts 23. As a further example, if the motor shown in FIG. 1 had the gear set 19, shown in FIG. 1, replaced by a gear set having twice the axial length of the gear set 19, the LSHT ratio would still be 1.0:1, but the HSLT ratio would now be 3.0:1, because the flow volume of the gear set 13 alone would now be about one-third of the flow volume of the two gear sets together. Based on this principle, almost any HSLT ratio can be selected, limited only by the practical limits on the minimum and maximum lengths of the gerotor gear sets, rather than the HSLT ratio being limited, as in the prior art, to the ratio of total volume chambers to active volume chambers.

By way of example only, the axial length of the first gerotor gear set 13 must be long enough to accommodate both of the spline connections 57 and 69, whereas the length of the second gerotor gear set must not be so long as to make the overall length of the motor excessive. However, within such practical limits on the lengths of the gear sets 13 and 19, the present invention makes it possible to select any HSLT ratio over a very substantial range.

The selector valve member 77 also defines a plurality N+1 of pairs of radial bores 107 (see also FIG. 3) and 109 (shown only in FIG. 5C). When the selector valve member 77 is rotated to the position shown in FIG. 5C, which corresponds to the "free wheel" mode of operation of the motor, each pair of fluid passages 95 and 97 is in fluid communication with its respective radial bores 107 and 109, respectively. As will be understood by those skilled in the art, when it is desired to operate the motor in the free wheel mode, no pressurized fluid is being communicated to the inlet port 25, and no pilot pressure is communicated to either of the fittings 81 or 83, such that the compression spring 93 biases the selector valve member 77 to the position shown in FIG. 3. In the free wheel mode, the second volume chambers 66 are in relatively unrestricted fluid communication with the case drain region 106 (fluid recirculation region), in the same manner as in the HSLT mode. However, in the free wheel mode, the first volume chambers 39 are also in relatively unrestricted fluid communication with the case drain region 106, by means of the respective fluid passage 95 and the radial bore 107.

Therefore, in the free wheel mode, the vehicle can be towed, and as the output shaft 45 rotates, the star members 35 and 65 orbit and rotate, while fluid is able to flow into and out of both the first and second volume chambers 39 and 66, with relatively little restriction to fluid flow. It should be understood that in the free wheel mode, fluid is not being forced by the rotation of the output shaft 45 to flow through the relatively more restricted commutating valving (i.e., the spool valve 43), but instead, all fluid flow is through the selector valve section 15, into and out of the volume chambers 39 and 66. Because the various flow orifices in the selector valving are wide open, it has been determined that, with the present invention, as the vehicle is towed, the temperature of the fluid will gradually rise to about 20 or 30 degrees F. above the "normal" temperature of the fluid, and then level off at that temperature. By way of contrast, it has been observed that, with the prior art motors, extended periods of towing of a vehicle could cause the temperature of the fluid to continually rise until the fluid would lose its lubrication capability, and the motor would then begin to gall, a phenomenon well known to those skilled in the motor art.

Although not illustrated specifically herein, it is believed to be within the ability of those skilled in the art, using the concept of the present invention, to provide a three-speed motor. To provide a three-speed motor would require that a second selector valve section be located behind the second gear set 19, and a third gear set be located between the second selector valve and the end cap 21. Lowest speed would occur when both selector valves are in the position of FIG. 5A. A medium speed would occur when the first selector valve is in the position of FIG. 5A and the second selector valve is shifted to the position of FIG. 5B. A high speed mode would occur when both selector valves are shifted to the position of FIG. 5B. Finally, free wheel mode would occur when both selector valves are shifted to the position of FIG. 5C.

Figure 6:
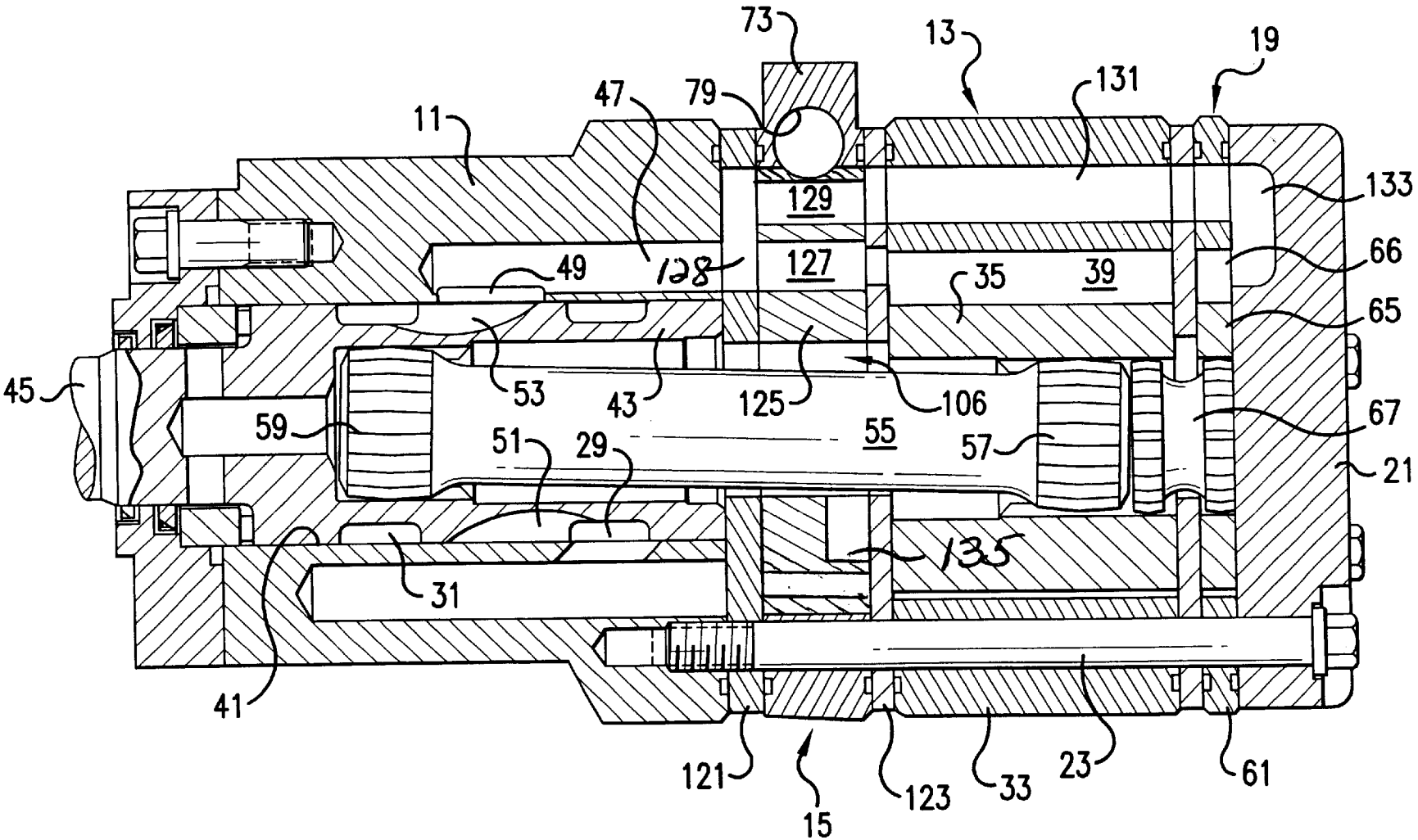
FIG. 6 is an axial cross-section of a gerotor motor illustrating an alternative embodiment of the present invention.

Referring now primarily to FIGS. 6 and 7A though 7F, there is illustrated an alternative embodiment of the present invention which differs from the primary embodiment mainly in the flow path of the fluid, and also somewhat in the arrangement of the selector valve section 15. In describing the operation of the alternative embodiment of FIGS. 6 and 7A through 7F, it should be noted that the same or similar elements bear the same reference numerals as in the embodiment of FIGS. 1–5, with new elements bearing reference numerals in excess of "120". Thus, in the embodiment of FIGS. 1–5, fluid flows through the first gear set 13, then through the selector valve section 15, then through the second gear set 19. In the alternative embodiment, fluid flows first through the selector valve section 15, then through the gerotor gear sets 13 and 19 in parallel (in LSHT mode), or through the selector valve section 15, then through one of the gear sets 13 or 19, while the other gear set communicates with case drain 106.

Referring still primarily to FIG. 6, on the forward and rearward sides of the selector valve section 15 are spacer plates 121 and 123, respectively. Disposed within the section 15 is a selector valve member 125 which defines a plurality 2 times (N+1) of fluid passages 127 and a plurality 2 times (N+1) of fluid passages 129, both of which are visible in FIG. 6. The fluid passages 127 provide fluid communication from the axial bores 47 to the first volume chambers 39, by means of radial slots 128 formed in the spacer plate 121, while the fluid passages 129 provide fluid communication from the axial bores 47 through axial bores 131, then through radial slots 133 formed in the end cap 21, into the second volume chambers 66. With the selector valve member 125 in the position shown in FIG. 6, corresponding to the position shown in FIGS. 7A and 7B, fluid is communicated to and from both sets of volume chambers 39 and 66, and the motor operates in the LSHT mode.

If the selector valve member 125 is rotated to the position shown in FIGS. 7C and 7D, to a position in which only the fluid passages 127 are available to communicate with the radial slots 128, fluid is communicated to and from only the first volume chambers 39, while the second volume chambers 66 are communicated to a fluid recirculation region which comprises an annular groove 134, formed about the outer periphery of the selector valve member 125. The fluid communication is by means of a radial slot 136 formed on the rearward face of the selector valve member 125, and in fluid communication with the axial bores 131 in the position shown in FIGS. 7C and 7D. In the subject embodiment shown in FIG. 6, when the motor shifts from LSHT (a 1.0:1 ratio) to a second speed, as shown in FIGS. 7C and 7D (which could be referred to as a "medium speed, medium torque" mode), the ratio is about 1.1:1, based on the relative lengths of the gerotor gear sets 13 and 19, as shown in FIG. 6.

If the selector valve member 125 is then rotated to the position shown in FIGS. 7E and 7F, to a position in which only the fluid passages 129 are available to communicate with the radial slots 128, fluid is communicated to and from only the second volume chambers 66, while the first volume chambers 39 are communicated to case drain 106, by means of a plurality N+1 of radial slots 135, shown in both FIGS. 6 and 7F. When the motor is shifted from the second speed to a third speed (the HSLT mode), the ratio is about 9.5:1, again based upon the relative lengths of the gear sets 13 and 19, as shown in FIG. 6. Thus, using the motor architecture of the alternative embodiment, it is possible to obtain three speeds with only two gerotor gear sets and only one selector valve section. Furthermore using the arrangement of either embodiment, it would be possible to achieve four speeds, simply by providing additional gerotor gear sets and selector valve sections.

It should be noted that for purposes of the appended claims, either gerotor gear set 13 or 19 could comprise either the "first" or the "second" gear set. Another significant feature of the invention is that, with either embodiment, it has been determined that it is feasible to shift from one speed (one mode) to another while the vehicle is moving, rather than having to bring the vehicle to a stop in order to shift speeds.

Figure 8:
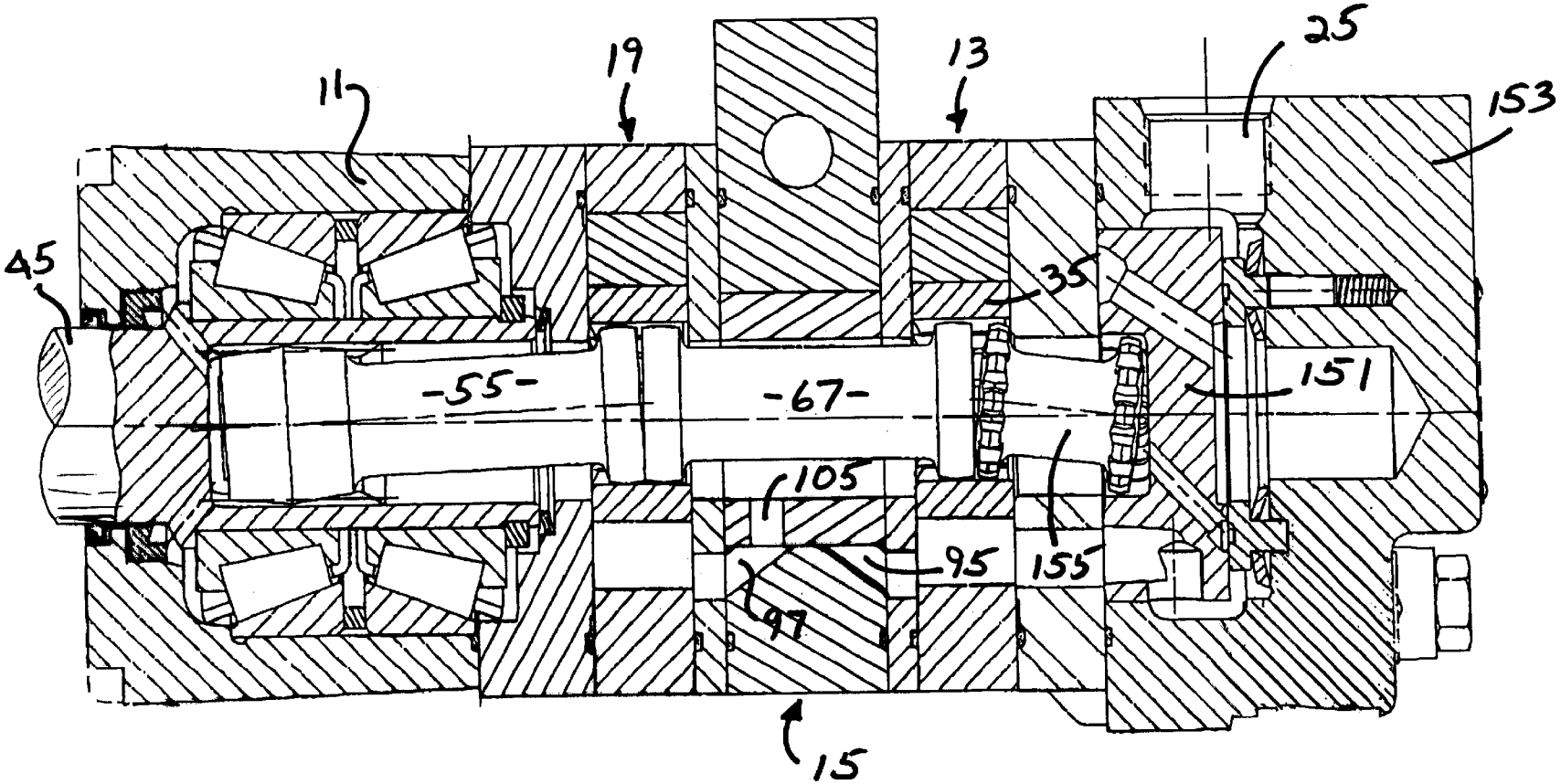
FIG. 8 is an axial cross-section of a gerotor motor of a type different than those shown in FIGS. 1 and 6, but including the selector valve arrangement substantially as shown in the embodiment of FIGS. 1 through 5.

Referring now primarily to FIG. 8, there is illustrated another embodiment of the invention, or perhaps more accurately, another type of gerotor motor, utilizing the invention as illustrated and described in connection with FIGS. 2 through 5. In the embodiment of FIG. 8, like elements bear like numerals and new or substantially modified elements bear reference numerals in excess of "150". The embodiment of FIG. 8 differs from that of FIG. 1 in several ways. First, rather than having a spool valve 43, the embodiment of FIG. 8 has a rotating disk valve 151, disposed within a valve housing section 153, in which case, the housing section bearing the reference numeral "11" in FIG. 8 is now merely a bearing housing section. Those skilled in the art will understand that disk valve motors of the general type shown in FIG. 8 (but without the selector valve 15 and the second gerotor 19) have been sold commercially for many years by the assignee of the present invention, are well known, and require very little description.

A second difference in the FIG. 8 embodiment is that the gerotor gear set 13 is disposed rearward of the selector valve section 15, because, to be consistent with the previous embodiments, it is the gerotor gear set 13 which is in direct fluid communication with the commutating valving, in this case, the disk valve 151. Another difference in the FIG. 8 embodiment is that, because of the presence of the disk valve 151, there is a valve drive shaft 155 transmitting the rotational movement of the star member 35 to the low-speed rotation of the disk valve 151. A final difference to be mentioned in regard to the FIG. 8 embodiment is that, because the first gerotor gear set 13 is "behind" the selector valve section 15, both the main drive shaft 55 and the secondary drive shaft 67 transmit torque from the star member 35 to the output shaft 45 when only the gerotor gear set 13 is providing torque output (in the HSLT mode). Otherwise, the selector valve section 15 could be nearly identical in configuration (and identical conceptually and in flow path) to what is shown in FIGS. 1, 3, and 5.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A rotary fluid pressure device comprising a housing defining a fluid inlet port and a fluid outlet port; fluid pressure operated displacement means associated with said housing and including a first internally-toothed ring member, and a first externally-toothed star member eccentrically disposed within said first ring member for relative orbital and rotational movement therein, to define a plurality N+1 of expanding and contracting first fluid volume chambers in response to said orbital and rotational movements; commutating valve means cooperating with said housing to provide fluid communication between said inlet port and said first expanding volume chambers and between said first contracting volume chambers and said outlet port in response to one of said orbital and rotational movements; and shaft means for transmitting said rotational movement of said first star member; characterized by:

(a) said fluid pressure operated displacement means including a second internally-toothed ring member, and a second externally-toothed star member eccentrically disposed within said second ring member for orbital and rotational movement therein, to define a plurality N+1 of expanding and contracting second volume chambers in response to said orbital and rotational movements;

(b) connection means for connecting said second star member to said first star member for common orbital and rotational movement therewith; and (c) selector valve means operably associated with said first and second ring members and operable in a first low speed position to permit fluid communication to each of said first volume chambers and its corresponding second volume chamber, and a second high speed position in which said commutating valve means permits communication of pressurized fluid to only one of said first and second volume chambers and permits fluid communication between each of the other of said first and second volume chambers and a fluid recirculation chamber.

2. A rotary fluid pressure device as claimed in claim 1, characterized by said first ring member and said first star member defining a first gerotor profile, and said second ring member and said second star member defining a second gerotor profile, said first and second gerotor profiles being substantially identical.

3. A rotary fluid pressure device as claimed in claim 1, characterized by said commutating valve means comprising a rotatable spool valve disposed in a spool bore defined by said housing, said shaft means comprising an output shaft formed integrally with said spool valve, and rotating at the speed of rotation of said first star member.

4. A rotary fluid pressure device as claimed in claim 1, characterized by said selector valve means being operable in a third free-wheel position to permit fluid communication between each of said first volume chambers and said fluid recirculation chamber, and between each of said second volume chambers and said recirculation chamber.

5. A rotary fluid pressure device as claimed in claim 4, characterized by said selector valve means comprising a selector valve housing disposed axially between said first and second ring members, and defining a generally cylindrical valve chamber, and said selector valve means further comprising a valve member disposed within said valve chamber and being rotatable therein among said first; second; and third positions.

6. A rotary fluid pressure device as claimed in claim 5, characterized by said selector valve housing defining a plurality N+1 of first fluid passages, each of said first fluid passages providing fluid communication between one of said first volume chambers and said cylindrical valve chamber.

7. A rotary fluid pressure device as claimed in claim 6, characterized by said selector valve housing defining a plurality N+1 of second fluid passages, each of said second fluid passages providing fluid communication between one of said second volume chambers and said cylindrical valve chamber.

8. A rotary fluid pressure device as claimed in claim 1, characterized by each of said first and second star members defining first and second sets of internal splines and said connection means comprising a dogbone shaft including first and second sets of external splines in splined engagement with said first and second sets of internal splines, respectively.

9. A rotary fluid pressure device as claimed in claim 8, characterized by said shaft means comprising a dogbone shaft, and said recirculation chamber comprises the interior of said device surrounding said dogbone shafts.

10. A rotary fluid pressure device as claimed in claim 1, characterized by said selector valve means comprising a selector valve housing disposed axially between said commutating valve means and said first ring member, and further comprising a selector valve member cooperating with said first and second ring members to define a plurality of fluid passages operable to communicate fluid from said commutating valve means to both said first and said second fluid volume chambers in said first low speed position.

11. A rotary fluid pressure device as claimed in claim 10, characterized by said selector valve member having a second position in which certain of said plurality of fluid passages is blocked from communicating fluid from said commutating valve means to said second fluid volume chambers.

12. A rotary fluid pressure device as claimed in claim 11, characterized by said selector valve member having a third position in which certain of said plurality of fluid passages is blocked from communicating fluid from said commutating valve means to said first fluid volume chambers.

* * * * *